US007872205B2

(12) United States Patent
Lamb

(10) Patent No.: US 7,872,205 B2
(45) Date of Patent: Jan. 18, 2011

(54) ELECTRICAL SWITCHES

(76) Inventor: Justin J. Lamb, 8365 SW. 88th Ave., Portland, OR (US) 97223

( * ) Notice: Subject to any disclaimer, the term of this patent is extended or adjusted under 35 U.S.C. 154(b) by 339 days.

(21) Appl. No.: 12/152,645

(22) Filed: May 14, 2008

(65) Prior Publication Data

US 2008/0283376 A1 Nov. 20, 2008

Related U.S. Application Data

(60) Provisional application No. 60/917,882, filed on May 14, 2007.

(51) Int. Cl.
*H01H 19/06* (2006.01)

(52) U.S. Cl. ..... 200/302.3

(58) Field of Classification Search .... 200/302.1–302.3
See application file for complete search history.

(56) References Cited

U.S. PATENT DOCUMENTS 2,780,691 A * 2/1957 Landin ..... 200/437
3,701,870 A * 10/1972 Sorenson ..... 200/317
5,053,591 A * 10/1991 Theurer ..... 200/339
5,105,059 A * 4/1992 Sorenson et al. ..... 200/302.3
6,255,610 B1 * 7/2001 Botz et al. ..... 200/315
6,422,330 B1 7/2002 Harris ..... 180/65.1
6,444,930 B1 9/2002 MacDonald et al. ..... 200/302.3

* cited by examiner

*Primary Examiner*—Renee S Luebke
*Assistant Examiner*—Lisa Klaus
(74) *Attorney, Agent, or Firm*—Kolisch Hartwell, P.C.

(57) ABSTRACT

An electrical switch may include a housing having a hollow inner cavity. Both mechanical and electrical components may be contained within the inner cavity. The components within inner cavity may be protected from contaminants entering the inner cavity by a seal adjacent to an opening of the housing leading from the inner cavity. The seal may allow movement of an actuator mechanism between various configurations relative to the seal, while continuing to prevent contaminants from entering the inner cavity.

17 Claims, 3 Drawing Sheets

ELECTRICAL SWITCHES

CROSS-REFERENCE TO RELATED APPLICATIONS

This application claims priority under 35 U.S.C. §119(e) to U.S. Provisional Patent Application Ser. No. 60/917,882 entitled Water Resistant Switches, filed May 14, 2007. The complete disclosure of the above application is herein incorporated by reference for all purposes.

TECHNICAL FIELD

The present disclosure relates generally to electrical switches and, more particularly, to electrical switches for use in harsh environments.

BACKGROUND

Electrical switches, such as rocker-switches, may be unsuitable for unprotected use in some environments. For example, the presence of moisture may cause arcing or short circuits, and/or may damage the switch, its contacts, and/or its working parts. Therefore, it may be desirable to shelter or protect a switch from exposure to water or other corrosive materials when the switch is to be used in a harsh environment.

Previous examples of protection for electrical switches have included flexible PVC membranes over the switch. However, such external membranes are vulnerable to removal, may be damaged by exposure to sunlight or heat, and/or may break down over a relatively small number of switching cycles. Internal membranes (within the switch housing), such as those shown in U.S. Pat. No. 6,444,930, have also been used, but such arrangements offer their own set of difficulties. While such internal membranes may seal the electrical contacts, some of the moving parts of the switch may remain exposed to contamination, and again, the membranes may be subject to failure after only a relatively small number of switching cycles.

DETAILED DESCRIPTION

Figure 1:
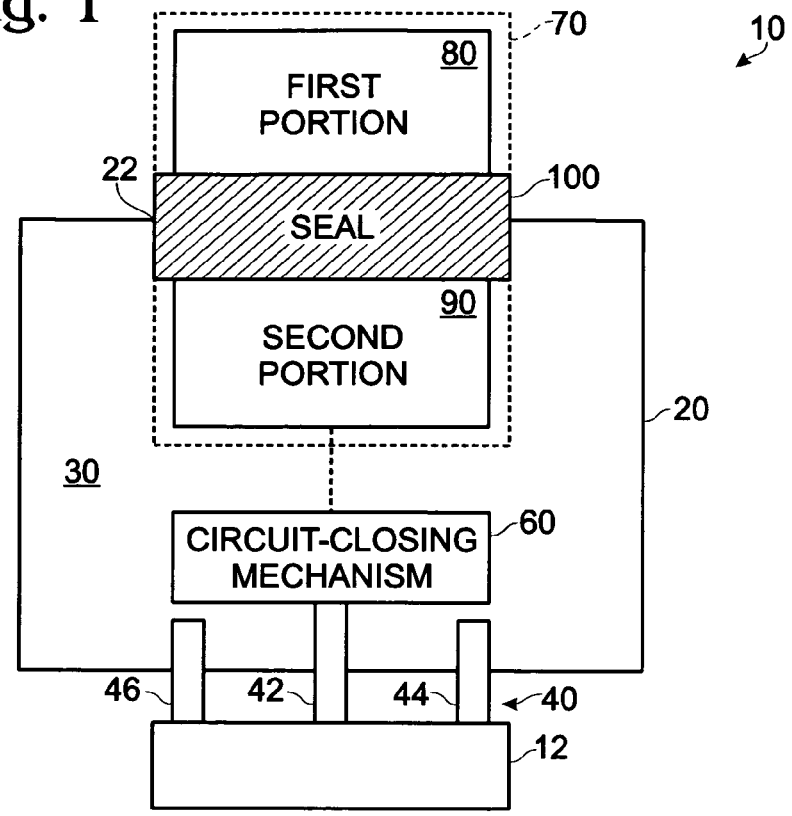
FIG. 1 is a schematic illustration of a water-resistant electrical switch.

An electrical switch, which may be a rocker-type or lever-type electrical switch, is shown schematically in FIG. 1 and indicated generally at 10. As indicated, switch 10 may include a switch housing 20 that defines a hollow inner cavity 30. Extending from the housing 20 is a plurality of electrical terminals 40, configured to accommodate placement of switch 10 in an ancillary circuit 12. A circuit-closing mechanism 60 is contained within housing 20, and configured to selectively connect the electrical terminals to close a loop in an ancillary circuit 12. As also indicated, circuit-closing mechanism 60 may be operated via an actuator mechanism (shown generally at 70).

Housing 20 also may provide a structural support or body which may generally retain and/or support the various components of the switch 10 in operative relation to one another. For example, housing 20 may support actuator mechanism 70 for operative communication with circuit-closing mechanism 60 (contained within housing 20 to protect the switch circuitry from a harmful environment). Housing 20 also may mount electrical terminals 40 such that circuit-closing mechanism 60 may be used to connect the electrical terminals 40 upon operation of actuator mechanism 70.

Actuator mechanism 70 may include a first portion 80 (that is at least partially external to switch housing 20) and a second portion 90 (that is at least partially internal to switch housing 20). Actuator mechanism 70 thus may pass through an opening 22 in the switch housing 20 from external housing 20 to internal housing 20 (i.e., within inner cavity 30). A seal 100 may be provided adjacent opening 22 to restrict flow of water or other materials into inner cavity 30 of the switch housing, thereby sealing internal cavity 30 and protecting the components therein from exposure to water or other harmful materials.

To control operation of circuit-closing mechanism 60, first portion 80 of actuator mechanism 70 may be manipulated (by hand or otherwise) to move actuator, mechanism 70 between first and second configurations. Manipulation of first portion 80 in turn may effect corresponding movement of second portion 90 of actuator mechanism 70, while still maintaining a sealed environment within internal cavity 30. Within the sealed internal cavity 30, second portion 90 may act upon circuit-closing mechanism 60 to effect selected electrical connections and/or disconnections between electrical terminals 40 of switch 10.

Still referring to FIG. 1, it will be appreciated that circuit-closing mechanism 60 may be configured to connect electrical terminals 40 by selectively bridging an expanse between electrical terminals 40 of the switch. For example, circuit-closing mechanism 60 may be employed to electrically connect a first terminal 42 to either a second terminal 44 or a third terminal 46. In this manner, actuator mechanism 70 may be employed to operate circuit-closing mechanism 60, and thus to selectively open and close a loop in ancillary circuit 12 without exposing components of switch 10 to harmful materials from the external environment.

Figure 3:
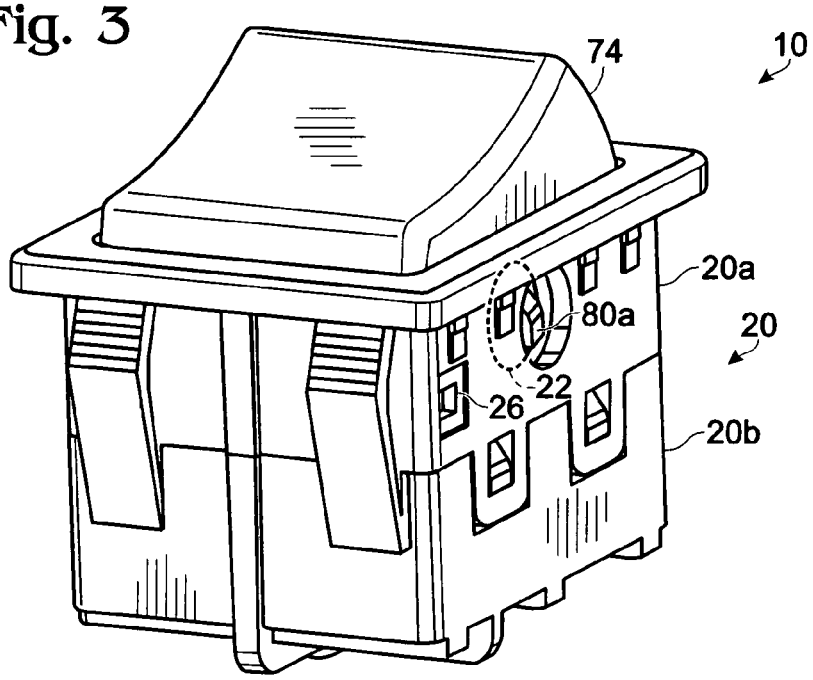
FIG. 3 is a perspective view of an assembled water-resistant electrical switch such as that shown in FIG. 2.
Figure 2:
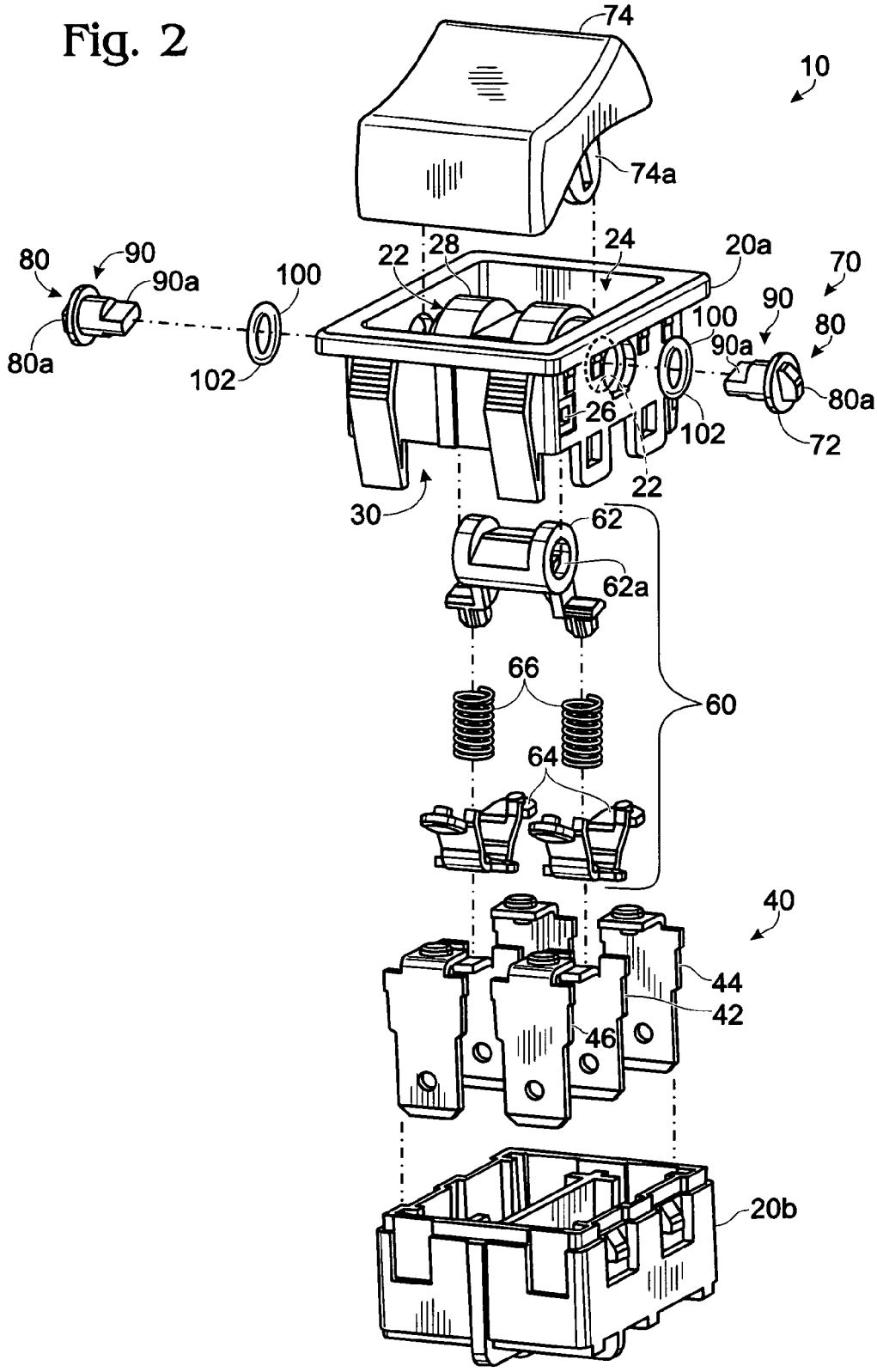
FIG. 2 is an exploded perspective view of an exemplary water-resistant electrical switch.
Figure 4:
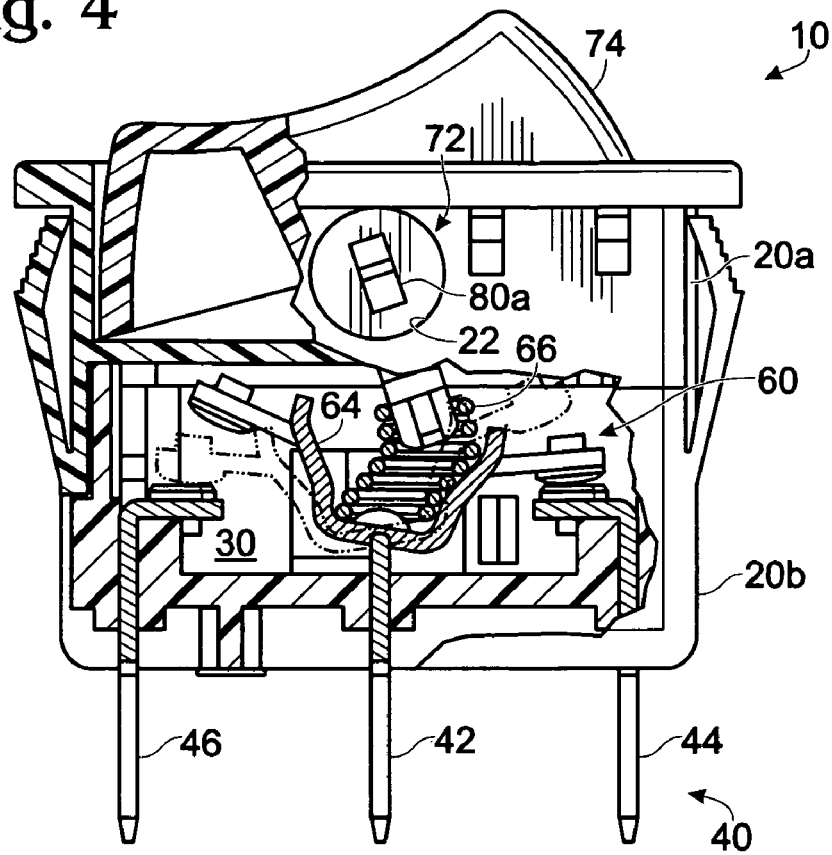
FIG. 4 is a partial cutaway view of the water-resistant electrical switch of FIG. 3.

In some embodiments, such as that shown in FIGS. 2-4, switch 10 may take the form of a double pole, double throw (DPDT) rocker switch. As indicated, switch 10 may include a housing 20 formed of a first housing portion 20*a* and a second housing portion 20*b*. Upon assembly, the housing portions may be sealed together (e.g., by use of a sealant, or electronic or heat welding of the components) to define internal cavity 30. Terminals in the form of blade connectors (indicated generally at 40) may extend through second housing portion 20*b*, and a seal may be formed where the blade connectors pass through housing 20. Housing 20 also may be defined with one or more openings 22, which accommodate access to circuit-closing mechanism 60 by actuator mechanism 70.

As best indicated in FIG. 2, actuator mechanism 70 may include one or more movable members 72 configured for insertion through corresponding housing openings 22. Each movable member 72 will be seen to take the exemplary form of a shaft with a first portion 80 configured to rest at least partially outside internal cavity 30, and a second portion 90 configured to rest at least partially within internal cavity 30. Furthermore, each shaft may be configured to receive a seal 100, in the exemplary form of an O-ring 102. Such O-rings will be understood to form a seal at each opening 22 when the shafts are inserted into the housing. In such embodiments, opening 22 may be circular in order to receive the shaft.

Seal 100 may be configured to permit the necessary motions of actuator mechanism 70 while substantially preventing water and/or other contaminants from entering inner cavity 30. In any case, during movement of movable member 72, seal 100 continues to prevent contaminants from entering inner cavity 30. To this end, seal 100, movable member 72 and/or opening 22 may have complementary surfaces that minimize friction between seal 100, opening 22 and/or movable member 72 to allow movement while still preventing contaminants from entering inner cavity 30. In some embodiments, seal 100 is at least partially formed of rubber.

Referring still to FIG. 2, it will be noted that the first portion 80 of each movable member 72 is configured to mate with a corresponding portion of a rocker 74. For example, each movable member 72 may include on its first portion 80 a tab 80*a*. After insertion of movable members 72, rocker 74 may be placed over tabs 80*a* such that corresponding recesses 74*a* of the rocker mate with tabs 80*a*. Of course, other cooperative relationships also are possible. Pivot of rocker 74 thus will effect corresponding movement of movable members 72.

Within housing 20, movable members 72 may be configured to operatively engage circuit-closing mechanism 60. For example, each movable member 72 may include a second portion 90 with a tab 90*a*. Upon insertion of movable members 72, tab 90*a* may mate with a corresponding recess 62*a* in a cam 62, operably coupling movable member 72 to cam 62. Of course, other cooperative relationships also are possible. Pivot of rocker 74 thus will effect corresponding movement of movable members 72, and corresponding movement of cam 62.

Referring now to FIGS. 2 and 4, it will be noted that circuit-closing mechanism 60 may include one or more electrically conductive pivot members 64 configured to pivot under direction of cam 62. Such operative relationship may be assisted by use of one or more spring members 66 which may be configured to drive pivot members 64 into the desired orientation upon selected movement of cam 62.

As best indicated in FIG. 4, pivot member 64 may be configured to connect terminals by selectively bridging an expanse between electrical terminals 40 of switch 10. For example, pivot member may be permanently electrically connected to a first terminal 42, but it may be pivoted to selectively electrically contact either a second terminal 44 (the orientation shown in FIG. 4) or a third terminal 46 (the phantom orientation shown in FIG. 4). Rocker 74 thus may be manipulated to rotate movable members 72, thereby rotating cam 62, and pivoting pivot members 64 to selectively define the current path through switch 10.

Although openings 22 may be located on various portions of housing 20, the exemplary housing locates the openings on opposite sides of a protuberance 28 extending from a recessed top surface 24. In this manner, switch 10 may be provided for a fitted cavity into which rocker 74 is placed upon assembly of the switch. This tends to further protect switch 10 from exposure to contaminants through openings 22.

In embodiments having a cavity such as that shown in FIGS. 2-4, housing 20 may be configured to discharge water that may collect proximate actuator mechanism 70 and/or openings 22. For example, housing 20 may define one or more drains 26 in the walls above recessed top surface 24.

It should be understood that while switch 10 is shown in isolation in FIGS. 2-4, switch 10 is meant to be installed into an electrical component, machine, device or other unit with a ancillary circuit employing an electrical switch. When switch 10 is installed, the bottom ends will be coupled electrically to the ancillary circuit of the electrical component, machine, device or other unit in a manner similar to that shown in the exemplary embodiment of FIG. 1.

All this may be accomplished without exposing components of switch 10 to harmful materials from the external environment, at least in part due to the use of one or more movable members 72 that communicate from the exterior to the interior of housing 20 while maintaining a sealed environment within housing 20.

Some embodiments may include a light source (not shown) disposed within inner cavity 30. The light source may be configured to emit light when actuator mechanism 70 is in one of the first or second configurations. At least a portion of housing 20 may be at least partially transparent or translucent so as to allow the light emitted from the light source to pass therethrough so that the emitted light is readily visible at an acceptable distance and/or angle, such as a visibility distance and/or angle established by the Underwriters Laboratories for a lighted switch.

Some embodiments may include actuators that utilize actuator mechanism including user interfaces other than the rocker shown in FIGS. 2-4. For example, the actuator mechanism may employ a toggle, a lever, or other mechanism suitable to effect movement of a movable member having a first portion at least partially external to a sealed switch housing and a second portion at least partially internal to a sealed switch housing.

It is believed that the disclosure set forth herein encompasses multiple distinct embodiments with independent utility. While each of these embodiments has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Applicant reserves the right to submit claims directed to certain combinations and subcombinations that are directed to one of the disclosed embodiments and are believed to be novel and non-obvious. Other combinations and subcombinations of features, functions, elements and/or properties may be claimed through amendment of those claims or presentation of new claims in that or a related application. Such amended or new claims, whether different, broader, narrower or equal in scope to the original claims, are also regarded as included within the subject matter of the present disclosure.

What is claimed is:

1. An electrical switch comprising:

a housing having an opening and a second opening to an inner cavity;

a circuit-closing mechanism disposed within the inner cavity;

first and second electrical terminals;

an actuator mechanism with a first portion disposed at least partially external from the inner cavity and a second portion disposed at least partially within the inner cavity, the first portion being manipulable to move the actuator mechanism between a first configuration where the second portion acts upon the circuit-closing mechanism to effect electrical connection between the first and second electrical terminals, and a second configuration where the second portion causes the circuit-closing mechanism to effect electrical disconnection between the first and second electrical terminals;

a cam operably coupled to a shaft that extends through the opening and a second shaft that extends through the second opening, wherein movement of the first portion causes the cam to rotate and effect an electrical connection between the first and second terminals;

a seal adjacent the opening and received on the shaft to prevent contaminants from entering the inner cavity; and a second seal adjacent the second opening and received on the second shaft.

2. The electrical switch of claim 1 wherein the shaft is moved when the actuator mechanism is moved between the first and second configurations, the shaft having a surface that is complimentary to a surface of the seal so that while the shaft is moved, the seal continues to prevent contaminants from entering the inner cavity.

3. The electrical switch of claim 2 wherein the circuit-closing mechanism comprises a pivot member, wherein rotation of the cam pivots the pivot member so that the pivot member effects an electrical connection between the first and second terminals.

4. The electrical switch of claim 3 wherein the pivot member is at least partially conductive and is pivotally mounted on the first electrical terminal so that it is electrically coupled with the first electrical terminal.

5. The electrical switch of claim 3 wherein the circuit-closing mechanism further comprises a spring member operably connected to the cam and the pivot member so that rotation of the cam causes the spring member to pivot the pivot member.

6. The electrical switch of claim 3 wherein the shaft has a tab configured to mate with a corresponding recess within the cam.

7. The electrical switch of claim 6 further comprising a rocker, wherein the shaft is configured to mate with the rocker so that pivoting of the rocker causes the shaft to rotate.

8. The electrical switch of claim 1 wherein the seal is at least partially comprised of rubber.

9. The electrical switch of claim 8 wherein the seal is an O-ring.

10. The electrical switch of claim 1 further comprising a third electrical terminal, wherein when the actuator mechanism is in the second configuration, the second portion causes the circuit-closing mechanism to effect electrical connection between the first and third electrical terminals.

11. The electrical switch of claim 1 further comprising a light source disposed within the inner cavity and configured to emit light when the actuator mechanism is in one of the first or second configurations, wherein at least a portion of the housing is at least partially transparent so that the transparent portion transmits the light emitted from the light source.

12. An electrical switch comprising:

a housing having an opening to an inner cavity;

a circuit-closing mechanism disposed within the inner cavity;

first and second electrical terminals;

an actuator mechanism with a first portion disposed at least partially external from the inner cavity and a second portion disposed at least partially within the inner cavity, the first portion being manipulable to move the actuator mechanism between a first configuration where the second portion acts upon the circuit-closing mechanism to effect electrical connection between the first and second electrical terminals, and a second configuration where the second portion causes the circuit-closing mechanism to effect electrical disconnection between the first and second electrical terminals; and a seal adjacent the opening to prevent contaminants from entering the inner cavity;

wherein:

the actuator mechanism includes a movable member that is moved when the actuator mechanism is moved between the first and, second configurations, the movable member having a surface that is complimentary to a surface of the seal so that while the movable member is moved, the seal continues to prevent contaminants from entering the inner cavity;

the circuit-closing mechanism comprises a cam and a pivot member, wherein the cam is operably connected to the movable member so that movement of the movable member causes the cam to rotate, pivoting the pivot member so that the pivot member effects an electrical connection between the first and second terminals;

the opening is circular and the movable member includes a shaft configured to receive the seal and extend through the opening, the shaft having a tab configured to mate with a corresponding recess within the cam;

the housing further comprises a second circular opening and the actuator mechanism further includes a second shaft configured to receive a second seal and to extend through the second opening, the second shaft having a second tab configured to mate with a second corresponding recess within the cam.

13. The electrical switch of claim 12 wherein atop surface of the housing includes a recess defined by inward-facing walls, and the first and second openings are disposed on opposite inward-facing walls

14. The electrical switch of claim 13 wherein at least one inward-facing wall includes a drain for expelling contaminants from the recess.

15. The electrical switch of claim 12 wherein a top surface of the housing includes a recess defined by inward-facing walls and a protuberance extending from the recess, wherein the first and second openings are disposed on the protuberance.

16. The electrical switch of claim 15 wherein at least one inward-facing wall includes a drain for expelling contaminants from the recess.

17. An electrical switch comprising:

a housing having a circular opening and a second circular opening to an inner cavity;

first and second electrical terminals;

a circuit-closing mechanism comprising a cam, a spring member, and pivot member pivotally mounted on the first electrical terminal, the pivot member being at least partially conductive so that it is electrically coupled to the first electrical terminal;

an actuator mechanism including a shaft and a second shaft operably coupled to the cam, the shaft having a first portion at least partially outside of the inner cavity and a second portion disposed within the inner cavity, the first portion being manipulable to rotate the shaft to rotate the cam, thereby causing the spring member to pivot the pivot member so that the pivot member selectively contacts the first and second electrical terminals simultaneously to effect electrical connection thereof; and a seal adjacent the opening and received on the shaft, and a second seal adjacent the second opening, the seals being adapted to prevent contaminants from entering the inner cavity of the housing while permitting rotation of the shafts.

* * * * *